US005622009A

United States Patent [19]

Healey

[11] Patent Number: 5,622,009

[45] Date of Patent: Apr. 22, 1997

[54] TILT TYPE WINDOW SUPPORT MECHANISM

[76] Inventor: John Healey, 20 Cooke Ave., Kingston, Mass. 02364-1837

[21] Appl. No.: 537,388

[22] Filed: Oct. 2, 1995

[51] Int. Cl.[6] ..... E06B 3/00

[52] U.S. Cl. ..... 49/507; 49/55; 211/87

[58] Field of Search ..... 49/507, 55; 211/87, 211/105.3, 104, 175

[56] References Cited

U.S. PATENT DOCUMENTS

| | | | |
|---|---|---|---|
| 2,171,476 | 8/1939 | Hines | 49/55 |
| 3,007,582 | 12/1961 | Lindstrom | 211/87 |
| 3,461,608 | 8/1969 | Johnson . | |
| 3,466,800 | 9/1969 | Nardulli . | |
| 4,111,309 | 9/1978 | Henry | 211/105.1 |
| 4,222,201 | 9/1980 | Yanessa . | |
| 4,337,597 | 7/1982 | Struckmeyer . | |
| 4,592,168 | 6/1986 | Struckmeyer . | |
| 5,070,647 | 12/1991 | Spialter | 49/55 |
| 5,244,238 | 9/1993 | Lindqvist . | |

FOREIGN PATENT DOCUMENTS

| | | | |
|---|---|---|---|
| 565934 | 6/1974 | Switzerland | 49/55 |

*Primary Examiner*—Kenneth J. Dorner
*Assistant Examiner*—Curtis Cohen

[57] ABSTRACT

A tilt type window support mechanism structure that is placed into the window frame of a conventional tilt type window. It fastens in the sidewalls of the frame and at the sill. It is capable of both extension and rotation about its connecting axis. These capabilities allow for optimum placement of the support frame under the tilted window, thus freeing the user from manually supporting the window in its desired position.

12 Claims, 2 Drawing Sheets

TILT TYPE WINDOW SUPPORT MECHANISM

BACKGROUND OF THE INVENTION

The present invention relates to a window supporting mechanism. More particularly it relates to a mechanism that provides support for tilting type windows to assist in painting, cleaning or other operations in which it is desirable to work on the window when it is tilted away from its casement. Although the field is replete with art pertaining to the means that such windows use to accomplish the tilting or pivotal action, no art was discovered pertaining to a means to secure the window pane once tilted. This is especially true considering that the subject mechanism can be used interchangeably to support numerous types, styles and brands of tilting type windows.

SUMMARY OF THE INVENTION

It is therefore an object of this invention to provide a tilting type window supporting mechanism that permits the user to tilt out an ordinary tilt type window pane and with proper placement of the mechanism, support said window pane in its tilted position.

It is another object of the present invention to provide a mechanism that will stabilize the window pane thereby reducing the potential for injury to the person working on the window.

It is still another object of the present invention to provide a mechanism that will support the weight of the window pane further reducing the potential for injury to the person working on the window.

Yet another object of this invention is to provide a mechanism which is capable of dimensional adjustment enabling use on various makes, manufacture, and sizes of tilt type windows.

Still another object of this invention is to provide a mechanism which can be constructed with a minimal amount of moving parts, negating costly repairs and maintenance.

Still another object of this invention is to provide a mechanism that can be manufactured from a variety of rigid, lightweight materials such as aluminum, fiberglass, plastic or the like; either new or recycled.

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of the specific embodiments when read and understood in connection with the accompanying drawings wherein:

DESCRIPTION OF THE PREFERRED EMBODIMENT

Figure 3:
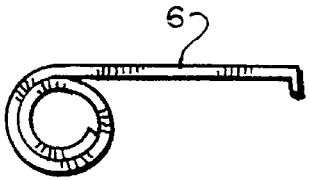
FIG. 3 is a plan view depicting the window sill catch of FIG. 1.
Figure 1:
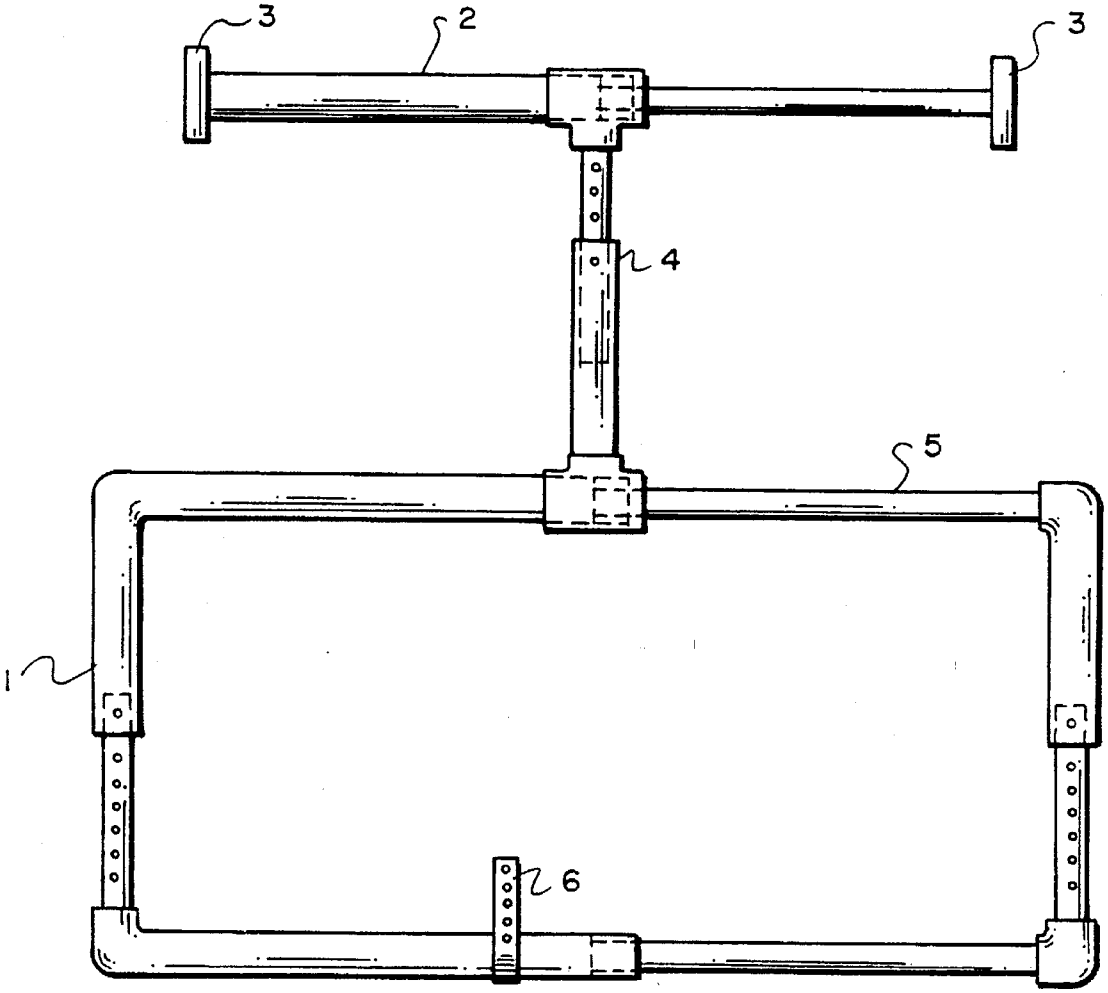
FIG. 1 is a plan view of the tilting type window supporting mechanism according to the present invention.

Referring now to the drawings and more particularly to FIG. 1, a preferred embodiment of a tilting type window supporting mechanism is designated generally by the numeral 1. This mechanism includes a retaining member 2 having a sash track foot 3 at each end and a connecting element 4 slidably attached to the center of retaining member 2; a window support 5; and a window frame catch 6.

Figure 2:
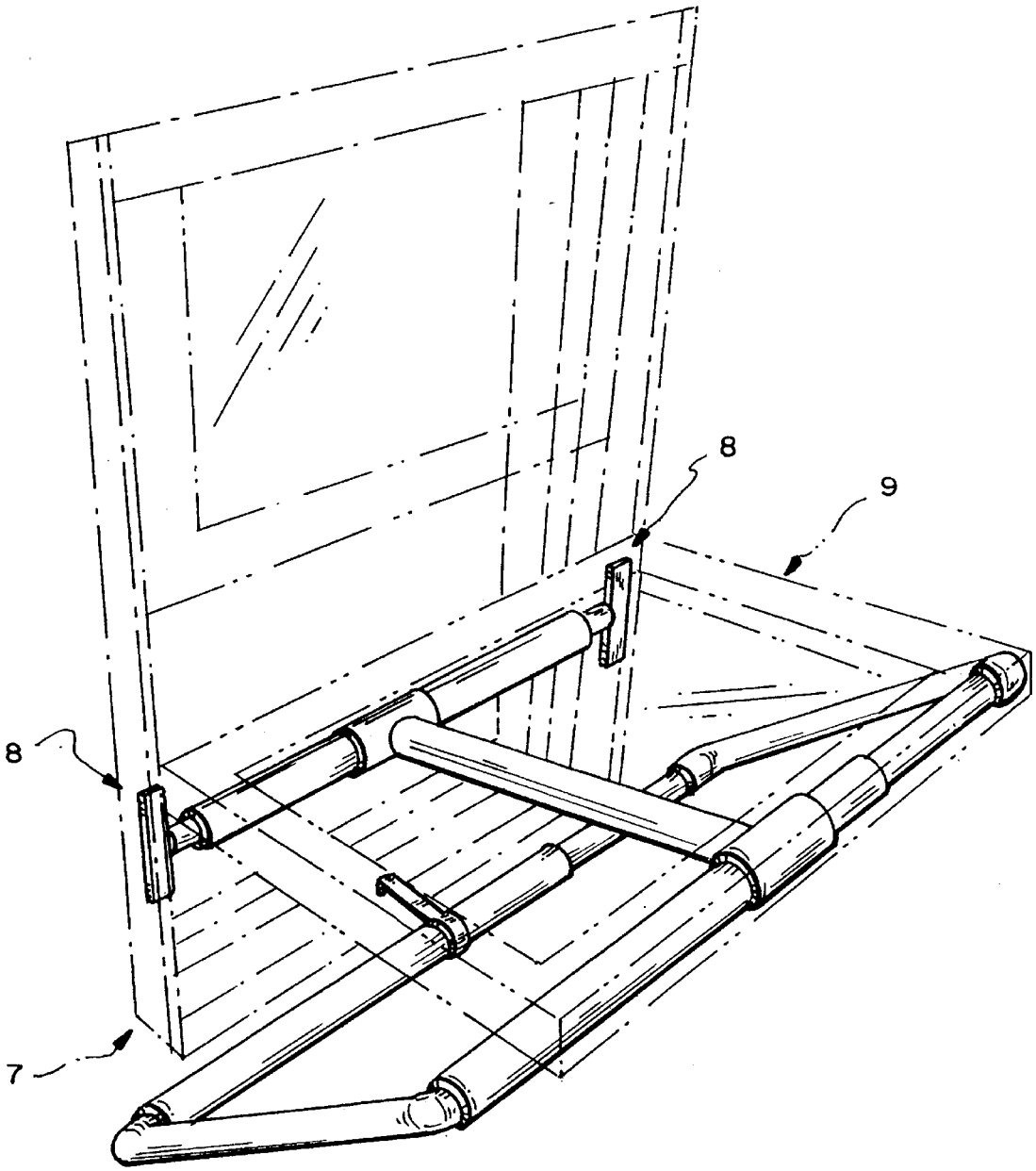
FIG. 2 is a perspective view depicting the present invention being used in conjunction with a tilting type window.

As can be seen in FIG. 2 mechanism 1 is placed directly on a window sill 7 and window sill catch 6, attached to one end of window support 5, is designed to catch and hook onto the edge of sill 7. Window sill catch 6 is adjustable in length to overcome dimensional inconsistencies in the sizing of window sills encountered. Retaining member 2 is extended to a length which enables sash track feet 3 to engage siderails 8 within which window 9 slides. Because siderails 8 are recessed in relation to the rest of the window casement, sash track feet 3 are sufficiently restrained from transverse movement which would cause sash track feet 3 from accidentally withdrawing from siderails 8.

After sash track feet 3 and window frame catch 6 are positioned, window 9 may be tilted in accordance with the window manufacturer's instructions until the disengaged end of window 9 rests upon window support 5. Window 9 can then be safely worked upon and the disengaged end will be supported by the mechanism.

Window support 5 is furnished with telescopic capabilities thereby providing an adjustable support structure for the disengaged end of window 9. Window support 5 is extended or retracted as necessary to provide window 9 the maximum support surface available. Connecting element 4 is slidably attached to the center of window support 5 at the end opposite window frame catch 6 by a pivoting means, one embodiment being a simple slide bearing surface. Connecting element 4 is also telescopic which enables connecting or retraction thereby allowing the user additional flexibility in placement of window support 5 in relation to the disengaged end of window 9.

Connecting element 4 is capable of slidingly moving along retaining member 2 and window support 5. This capability enables connecting element 4 to be centered in a window frame even if window support mechanism is in a fully retracted position.

In the preferred embodiment, means such as push pins or the like can be provided to lock the telescoping elements once the proper extension is determined. These push pins engage holes drilled through both telescoping elements of each retaining member 2, connecting element 4 and window support 5 thereby preventing any further extension or retraction of the telescopic elements. The telescopic elements are also provided with a channel and pin arrangement, where a channel is machined longitudinally along one length of the male element of the telescopic elements and the channel receives a corresponding pin located on the inside diameter of the female element. In a preferred embodiment, a total of two channels or two pins are located on each telescopic element, each located in diametrical opposition, i.e., 180 degrees apart. Their combined operation prevents rotational movement of the telescopic elements, enhances stability, and allows a more fluid adjustment of the telescopic elements.

By manipulating the telescopic elements of connecting element 4 and window support 5, in combination with the placement of each of sash track feet 3 within siderails 8 and window sill catch 6; the user is provided a wide range of latitude on window models that can be used with this invention. The user can also tilt the window over an infinite number of degrees and still support the disengaged end safely and easily.

It is to be understood the present invention is not restricted to the above-described embodiment, but may be varied within the scope of the appended claims. Since numerous modifications and changes will readily occur to those skilled in the art, accordingly all such modifications and equivalents which fall within the scope of the claims may be resorted to.

I claim:

1. A tilting type window supporting mechanism comprising;

a window support structure having both a top element, at least one window sill catch to secure the bottom element of said window support structure in use with a window sill, a retaining member, said retaining member capable of extension within jamb liners of said window frame whereby said jamb liners are capable of securing said retaining member within said window frame, and a connecting element wherein said connecting element is slidably mounted to said retaining member at a first end and to the top element of said window support structure at a second end, said top element capable of supporting a disengaged end of a tilt type window pane.

2. A mechanism as claimed in claim 1 wherein said connecting element is pivotally connected to said top element of said window support structure.

3. A mechanism as claimed in claim 2 wherein said window support structure is expandable and contractable in at least one dimension.

4. A mechanism as claimed in claim 3 wherein said window support structure is expandable and contractable in the direction corresponding to the axis of said top and bottom elements, thereby enabling lengthening and shortening of said elements.

5. A mechanism as claimed in claim 4 wherein said window support structure is expandable and contractable in a direction corresponding to the axial displacement of said top and bottom elements with respect to said elements, thereby enabling an increase or decrease in the distance between the respective axes of said elements.

6. A mechanism as claimed in claim 5 wherein said connecting element is capable of expansion and contraction along its axial length.

7. A mechanism as claimed in claim 6 wherein said expansion and contraction is accomplished by telescoping means.

8. A mechanism as claimed in claim 7 wherein said telescoping means further include limiting means to eliminate travel of said telescopic means when said limiting means are engaged.

9. A mechanism as claimed in claim 8 wherein said limiting means are pins, said pins protrude into said telescopic means effectively pinning said telescopic means thereby eliminating further telescopic displacement.

10. A mechanism as claimed in claim 9 wherein said window sill catch is adjustable to accommodate placement for use with and on various size window sills encountered in the art.

11. A mechanism as claimed in claim 1 wherein said retaining member further includes a foot attached to each end of said retaining member, said feet are capable of impinging upon said window frame jamb liners, thereby effectively securing member within said window frame.

12. Apparatus for supporting a disengaged end of a tilting type window which comprises:

a retaining member which is capable of protruding into jamb liners of the window frame;

a window sill catch which is capable of hooking onto the window sill;

a window support structure positioned upon and for the use with the window sill and held in position by a window sill catch;

a connecting element connecting window support structure to retaining member;

means for rotating connecting element about window support structure so that angle of adjustment between connecting element and window support structure is variable; and means for adjusting length of the connecting element so that window support structure can be placed in optimal position to be capable to support the weight of the disengaged end of the window.

* * * * *